United States Patent [19]

Burnight

[11] 3,999,465

[45] Dec. 28, 1976

[54] MAGNET PISTON RETENTION FOR FREE WHEELING

[75] Inventor: Thomas R. Burnight, Battle Creek, Mich.

[73] Assignee: Clark Equipment Company, Buchanan, Mich.

[22] Filed: Nov. 1, 1974

[21] Appl. No.: 519,962

[52] U.S. Cl. ..... 91/498; 91/501

[51] Int. Cl.[2] ..... F01B 13/06

[58] Field of Search ..... 92/15; 91/491, 498, 91/488, 492

[56] References Cited

UNITED STATES PATENTS

| | | | |
|---|---|---|---|
| 1,896,448 | 2/1933 | Kercher | 418/158 |
| 2,588,342 | 3/1952 | Bidwell | 418/158 |
| 2,952,249 | 9/1960 | Conover | 418/158 |
| 2,983,922 | 5/1961 | Juilfs | 92/15 |
| 3,016,019 | 1/1962 | Rineer | 418/158 |
| 3,027,876 | 4/1962 | Strick | 92/15 |
| 3,151,529 | 10/1964 | Leath | 91/491 |
| 3,173,376 | 3/1965 | Hulmann et al. | 91/488 |
| 3,435,774 | 4/1969 | Parrett | 91/501 |
| 3,824,899 | 7/1974 | Dzioba | 91/491 |
| 3,834,276 | 10/1974 | Gournelle | 92/15 |
| 3,913,455 | 10/1975 | Green | 91/492 |

FOREIGN PATENTS OR APPLICATIONS

| | | | |
|---|---|---|---|
| 1,249,873 | 11/1960 | France | 91/205 |
| 1,947,585 | 6/1970 | Germany | 91/491 |

*Primary Examiner*—William L. Freeh
*Attorney, Agent, or Firm*—John C. Wiessler

[57] ABSTRACT

A fixed displacement fluid motor or pump of the ball or roller piston type in which a plurality of axially or radially extending reciprocating pistons co-act with a cam track to produce output motion or to generate pressure fluid output, respectively. Permanent magnets are secured either to the pistons or in or adjacent the cylinders for holding the pistons in fixed retracted positions beyond one end of the normal stroke of the pistons under certain conditions of relatively low fluid operating pressure in the cylinders which occur in modes of operation during which no motor or pump output is desired.

11 Claims, 7 Drawing Figures

MAGNET PISTON RETENTION FOR FREE WHEELING

BACKGROUND OF THE INVENTION

The field of art to which the invention relates includes motors and pumps, and more especially fixed displacement fluid motors and pumps.

It has long been a problem in the art to which this invention pertains to effectively disengage during certain modes of operation of fluid motors and pumps of the type contemplated, the cam track and pistons such that during high speed free-wheeling operation, for example, of the motor or pump the pistons are held in inactive retracted positions without engaging the driving cam surface at any point in the rotary cycle of operation, thereby both protecting the motor or pump from damage as a result of the pumping action of the pistons at excessive rpm, and minimizing the wear and tear of parts associated with reciprocating parts. Heretofore, to my knowledge, no fully satisfactory means has been devised for effectively operating at high speed, fixed displacement fluid motors or pumps while holding the pistons thereof in fixed inoperative positions.

In the use of hydrostatic wheel motors in certain types of vehicles, such as an off-the-road construction type tractor vehicles, for example, it is often necessary to tow the vehicle on highways from one work location to another. Heretofore in certain applications highway towing speeds have been relatively low in order to minimize wear and tear on parts such as pistons, cylinders and bearings, and so that the motors were not damaged or destroyed by high speed towing operation beyond the design limits of the motors.

Again, in operating certain types of cable winches it is desirable, for example, to disengage the winch drive from time to time in a high speed cable pull-off operation. My invention is adapted to effectively disengage such a winch drive motor to stop the piston action which would otherwise occur. Also, for example, it is frequently desirable to accelerate a fly wheel to a relatively high speed to store energy, subsequent to which the fly wheel speed and energy is conserved by minimizing losses. During such fly wheel acceleration powered by the engaged drive motors it is then desirable to disengage the pistons by holding them in retracted positions, and following fly wheel acceleration to conserve fly wheel speed and energy and then extract the stored energy as needed from time to time by reenergizing the pistons when drawing power from the flywheel.

Fixed displacement camming ball or roller radial or axial piston type air compressor motors, steam engines and pumps may be used in a variety of applications in which the kind of problem indicated above exits. My invention may be applied to all such exemplary types of fluid motors or pumps to provide overspeed protection, and/or reduce wear and tear on the motor or pump under certain operational modes, and/or minimize the noise and heat losses generated in such modes of operation.

SUMMARY

As is pointed out above, my invention is capable of numerous embodiments or forms in respect of the type of fluid used in various types of motors and pumps; it solves the types of exemplary problems stated in respect of the many different applications in which such types of fluid motors or pumps may be utilized.

The invention provides an extremely simple construction in which a relatively low cost magnetic means is used under certain operational conditions to hold such pistons in any such types of motors or pumps in retracted positions out of contact with a cam track and stationary in the cylinders in which they normally reciprocate.

It is therefore a primary object of the invention to provide a means for effectively disengaging pistons from the cam track of any such fixed displacement fluid type motor or pump.

It is a further object to provide in such motor or pump types extremely simple and low cost means for holding the pistons under conditions of relatively low fluid operating pressure in fixed retracted positions beyond one end of the normal stroke of the pistons during certain operational modes.

Another object is to provide improved means for overspeed protection, and to minimize wear and tear and undesirable heating on motors and pumps of the types contemplated.

DETAILED DESCRIPTION

Figure 1:
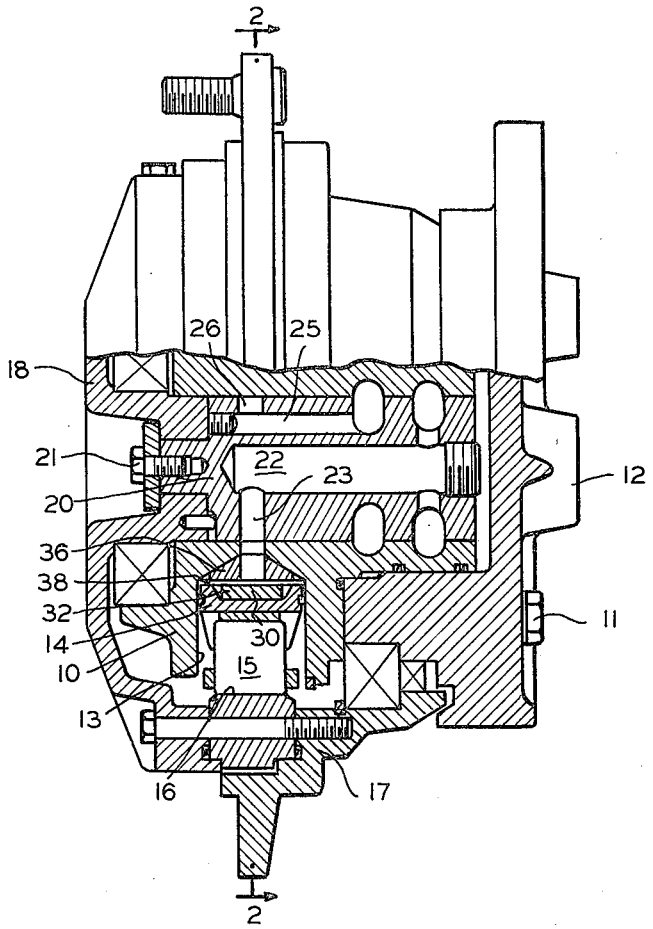
FIG. 1 is a partial cross-sectional view of a radial piston motor or pump of the axial roller piston type.
Figure 2:
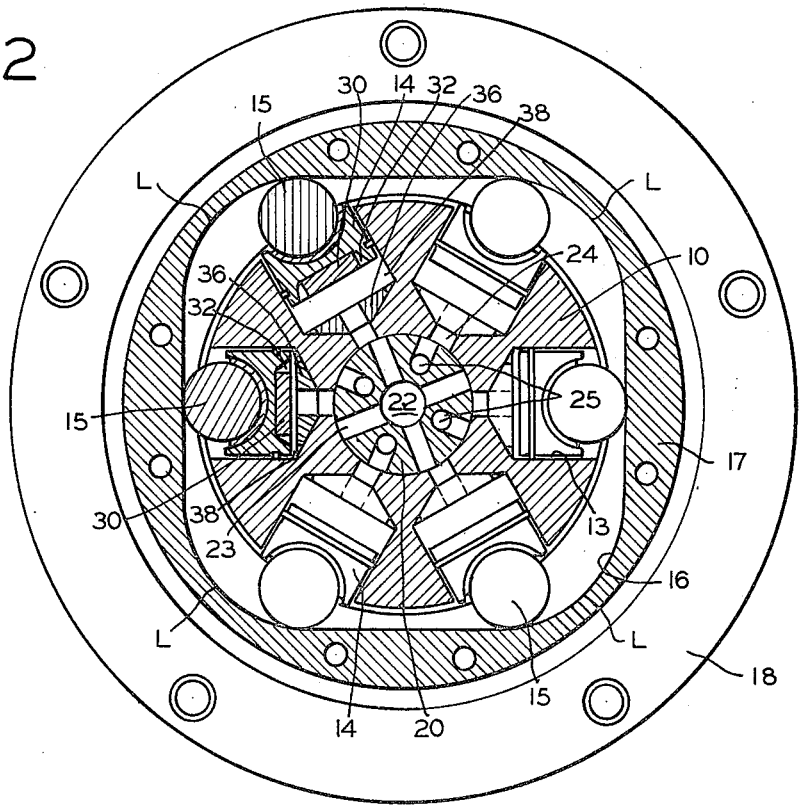
FIG. 2 is a cross-sectional view taken along line 2—2 of FIG. 1.

FIGS. 1 and 2 show an exemplary embodiment of a positive-displacement fluid pressure machine, operable as a pump or motor, of the type having a plurality of reciprocating pistons sliding in cylinders which travel together, linearly or angularly, relative to a cam which extends transversely to the axes of piston movement, the pistons having cam followers which co-act with the cam as the pistons reciprocate and which traverse each portion of the profile of the cam in succession.

A hydrostatic wheel motor is illustrated which comprises a non-rotatable cylinder block 10 mounted fixedly by means of a ring of bolts 11 on an axle 12 formed with six radial cylinders 13 at 60° angular spacings. In each cylinder is a piston 14 carrying a cylindrical cam follower roller 15 which co-acts with a cam track 16 positioned in the interior of a wall 17 of a wheel hub assembly 18. Pistons 14 co-act with the cam track 16, and the wheel hub assembly 18 is journaled suitably on the axle 12 for rotation by the co-action of the piston follower 15 with the cam track.

A valving pintle 20 is secured to the wheel hub assembly 18 by means of a bolt 21 for rotation therewith in a central bore in the fixed cylinder block 10, and is provided with a central fluid supply passage 22 to which pressure fluid is supplied, and with radial supply ports 23 which cooperate with inlet ports 24 in the cylinder block leading into cylinders 13. The pintle 20 also has axial discharge passages, one of which is shown at 25, each having a radial discharge passage 26 also cooperating with inlet ports 24. The supply passages 23 and the discharge passages 26 alternate angularly, as viewed in FIG. 2, so that as the pintle 20 rotates each cylinder in turn is first supplied with pressure fluid to drive the respective piston radially outwardly through its working stroke, and is then connected to the discharge passage to allow the escape of fluid and the inward return stroke of the piston. The axial supply and return passages 22 and 25 are respectively connected to pressure fluid supply and return connections (not shown) on the axle 12.

The profile of each of the four cam lobes L of the cam track 16 is comprised of two halves which are mirror images of one another and subtend 45° apiece at the motor axis. As the hub assembly 18 rotates with the cam tracks 16 and pintle 20 about the fixed cylinder block 10, the cylinders will be supplied with pressure fluid in turn from the pintle supply ports 23, appropriate cylinders being energized as required to provide the working strokes of respective pistons 14. During the working stroke each piston will co-act through its follower roller 15 with one-half of a cam lobe L along which half the roller 15 will travel relatively to the cam track 16 as the piston 14 is driven outwardly by the fluid pressure acting on its face. As shown, the pistons are actuated to a fully extended position as they traverse the four lobe sections of the cam track, and are actuated to a fully retracted operational position as they traverse the central portions between pairs of lobes. The construction of the motor as described above in respect of FIGS. 1 and 2 is conventional.

The motor as disclosed in FIGS. 1 and 2 is merely representative of one pump or motor type in which the invention to be now described in conjunction therewith may be utilized. For example, the invention may be applied to a ball piston pump or motor such as disclosed in U.S. Pat. No. 3,561,329, or any one of a variety of radially actuated piston rotary motor or pump types in which the pistons are actuated in reciprocatory motion by a cam track, and in which either the cam track or the cylinder block may be rotated, depending upon the particular application.

In FIGS. 1 and 2 I have combined in the hydrostatic pump or motor as disclosed a means for securing all of the pistons in a fully retracted condition during rotation of the wheel with hub assembly 18, such as in a free-wheeling situation in which an off-the-road tractor is being towed at highway speeds, it being essential under such conditions to effectively deactivate the pump or motor in such a manner that the pistons remain fully retracted and out of contact with the cam track during rotation thereof.

As illustrated in FIGS. 1 and 2, I am able to effect this result simply by utilizing permanent magnet elements 30, shown as disc-shaped elements, secured inside of a dish-shaped cavity 32 in the bottom of each piston which provides between the piston head and the periphery of the magnet an annular air gap 34. Of course, in practice a lubrication passage, not shown, is provided through the magnet and piston head in order to lubricate the bearing liners located between the piston head and roller. Cooperating with each magnet is a tapered soft iron or steel pole piece 38 which, as illustrated, is secured in a dish-shaped cavity at the bottom of each cylinder 13 and through which extends one of the cylinder ports 24.

In normal operation as a motor the pistons are actuated at full operational retraction to within a fractional-inch distance of the outer flat surface of the pole pieces 36 by the action of the rotating cam 16, as shown in FIG. 1, and also as shown at the pistons located horizontally in FIG. 2. The supply pressure from a charging or supply pump actuates the pistons outwardly of the cylinder from full operational retraction to maximum extension which occurs in the lobe sections of the motor while the rollers 15 remain in constant contact with the surface of the cam track. Preparatory to towing the tractor at highway speeds, the tractor drive train is, of course, immobilized so that the hydrostatic motor-in-wheel at each wheel receives no fluid pressure supply from the supply or charging pump. Under these conditions the magnets 30 function to pull the pistons into contact with each respective pole piece 36 and hold the same in said position as each piston is actuated by the rotating cam to the inner end of the cylinder. When the supply or charge pump is in operation the pressurized fluid which is supplied to each cylinder applies a sufficient force to the piston to disengage the magnet from the pole piece, whereupon the motor operates again in a normal manner. The design is such that during such tractor towing operations the rollers 15 do not contact any portion of the cam surface 16 thereby avoiding completely the wear and tear, heating, and reciprocatory motion of the pistons, as well as avoiding the possibility of damaging or even destroying the motor if the pistons are not thus deactivated and the pistons are driven as in normal operation at much higher than design or rated speed. A suitable magnet material for such installations is manufactured by, for example, the General Electric Company, and is known as "Alnico 5".

The design criteria in such applications of magnets are well known to persons skilled in the art. For example, it will be appreciated that particular design criteria of any pump or motor utilizing my invention must relate to the pull-in distance (at numeral 38 in FIGS. 1 and 2) from a fully retracted position of each piston to full engagement with pole piece 36, and to the holding force required to retain the piston in its engaged position regardless of outside forces, such as dynamic road shock, which may tend to disengage the piston from the cylinder block during tractor towing operations, for example. The magnet force must also be sufficient, of course, to overcome both frictional forces and gravity forces, such as in respect of pistons which are located in a vertically downward position, at the pull-in distance. Primary magnet design criteria in such applications include air gap width, magnet strength, and quality of the flux path to achieve a good magnetic circuit.

It is important that the design effects a direct linear pulling force as between the pole piece and the magnet so that in no event is the piston dependent upon a direction of pull which involves shearing forces as between the pole piece and the magnet. In other words, and as viewed in FIGS. 1 and 2, a direct linear pulling force occurs between the pole piece and the magnet in the design as shown in that the pulling force lines are parallel to the cylinder axis, and act in said direction through the air gap 38. Thus, in such an exemplary free wheeling operation when the engine and pump are inoperative, under which condition system pressure is substantially zero, insufficient pressure is present in the cylinders to overcome the magnetic holding force, and the pistons are retained in such retracted inoperative positions.

Of course, the width and length of the air gap 34 and the particular materials used in both the pole piece and the magnet are important in establishing the flux path and the flux density, and therefore the holding power and the pull in distance available in the magnetic circuit. A proper ratio of the holding force and pull in distance must be established in order to obtain desired results in any application of my invention.

It should be understood that the embodiment disclosed in detail herein in respect of use of the invention on a towable tractor, or any other embodiment which may utilize sub-normal absolute inlet or charging pressure to enable operation of the magnet, is not intended in any sense to limit the use of the invention to any system wherein a low absolute pressure may be used. As will be apparent to persons skilled in the art the important factor in this respect is relative pressure, not absolute pressure.

A few modified structures are shown in FIGS. 3-6. A lubrication passage 44 is shown in FIGS. 3–6 which extends through the piston head to lubricate the bearing element 46 which engages the roller 15. Otherwise the design is essentially the same as in FIGS. 1 and 2, except as noted below.

Figure 3:
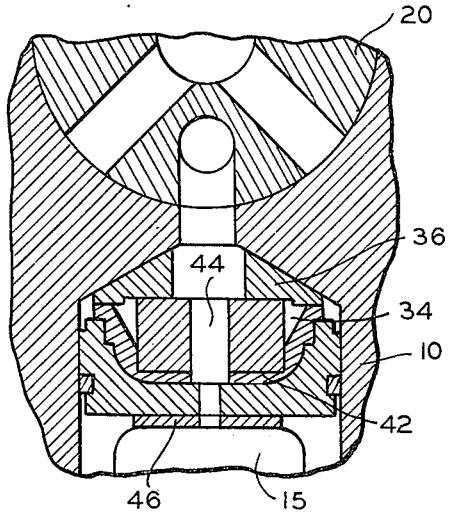
FIGS. 3, 4, 5 and 6 are enlarged sectional views of modified forms of my invention shown in relation to one of the pistons of the unit shown in FIGS. 1 and 2.

FIG. 3 shows an enlarged section of one of the cylinder piston constructions wherein a liner 42 has been inserted between the magnet and the dish cavity formed in the bottom of the piston for the purpose of providing a more efficient flux path, the piston material in this instance being assumed to have poor magnetic properties. The liner may be soft steel, for example, the magnet being secured to the liner and the liner in turn being secured to the surface formed by the cavity in the piston.

Figure 4:
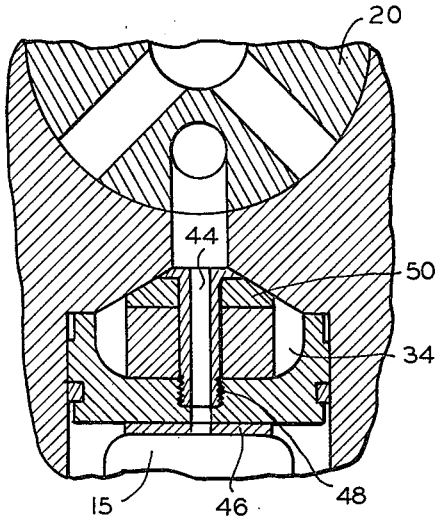

In FIG. 4 the magnet is secured to the piston by a threaded member 48, the lubrication passageway 44 extending through the threaded member, and a soft pole piece 50 of modified design providing a larger air gap 34 than previously.

Figure 5:
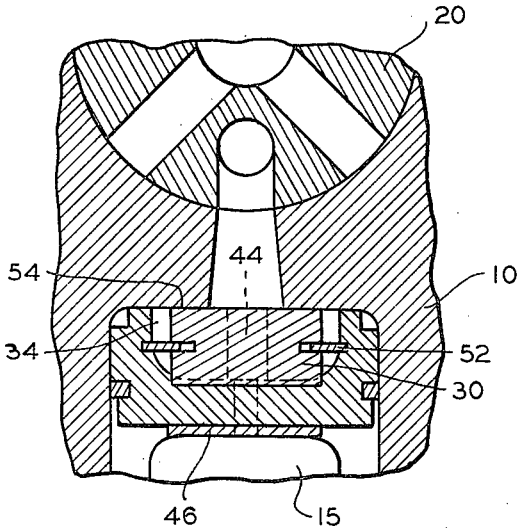

FIG. 5 shows a design in which the magnet is held in place in a cavity of the piston head by a snap ring 52, and the cylinder block 10 is of a design which does not provide dish shaped cavities for receiving pole pieces such as at 36 in FIGS. 1 and 2. Instead, the material properties of the cylinder block 10 is such that the magnet 30 interacts directly with the flat surface 54 of the cylinder block to establish the magnet circuit. Of course, a pin could be substituted, for example, for the snap ring 52 to extend through the piston head and the magnet to hold the latter in position in FIG. 5.

Figure 6:
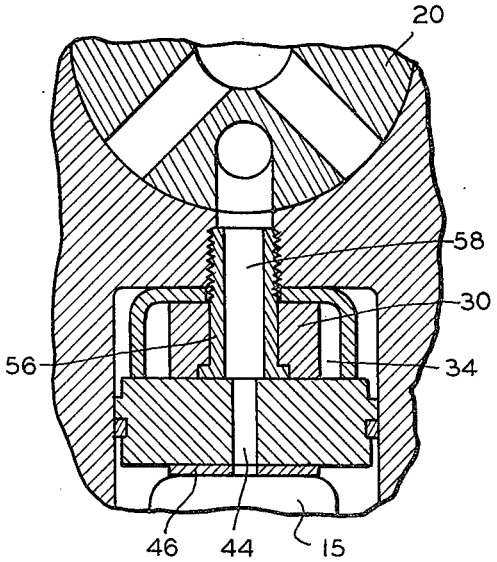

In FIG. 6 is disclosed a construction in which the magnet 30 is secured in the cylinder block by a stud 56 which extends through the magnet and into the block, the stud having an opening 58 therethrough providing pressure fluid to the piston head, the piston head having suitable pole piece magnetic properties which interacts with the magnet to establish the magnetic circuit. Many other variations are available to the designer in different applications and product types and designs which may utilize the invention.

Figure 7:
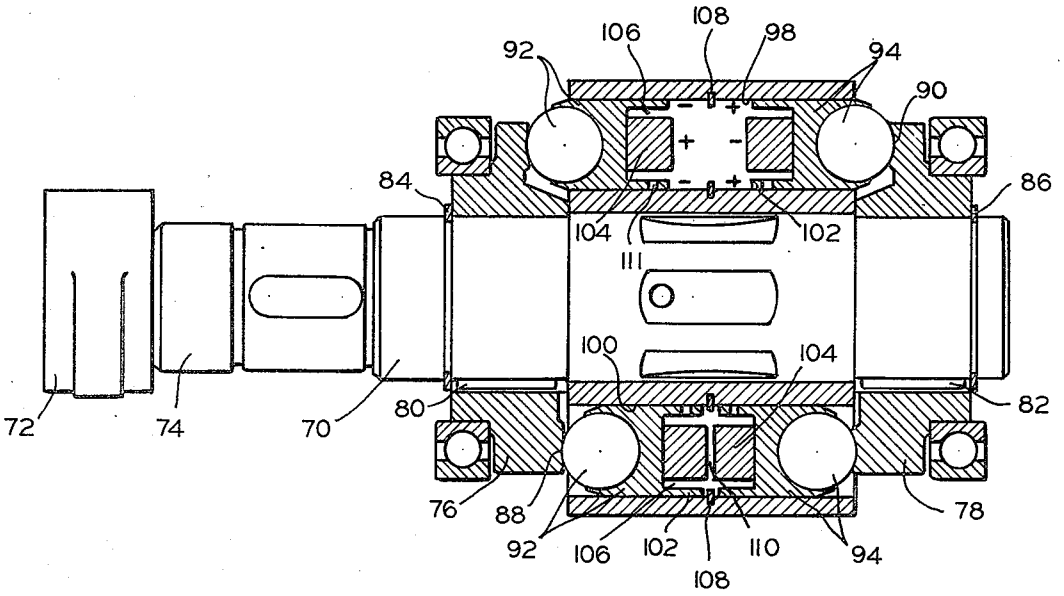
FIG. 7 is a longitudinal sectional view of a portion of an axial piston fluid motor or pump.

Referring to FIG. 7, a longitudinal sectional view of the essential working parts of an opposed cam actuated axial pistom pump or motor is shown, of a type such as is manufactured by Carron Hydraulics of Carron, Falkirk, Scotland. A drive shaft is shown at 70 having an inlet and outlet porting block 72 connected thereto by a threaded collar 74; a pair of camming plates 76 and 78 are key connected to the drive shaft at 80 and 82 and by snap rings 84 and 86.

The cam plates 76 and 78 have cam races 88 and 90 engaging a plurality of parts of circumferentially spaced opposed pistons 92 and 94. The pairs of pistons are mounted in respective cylinders such as 98 and 100 of the pump or motor body, hydraulic fluid entering into and discharging from an annular ring of such cylinders in the pump body by way of suitable porting means in the shaft and in the pump body, details of which need not be described herein. All of the cylinders are mounted on shaft 70, two of them being shown in the section of FIG. 7.

Each piston includes an annular wall 102 forming a cylindrical cup inside the piston in which is mounted a permanent magnet 104, opposed magnets in each pair of opposed pistons having opposite polarity so that they form a magnetic circuit which tends to actuate by attraction the opposed pairs of pistons into contact with each other. The magnets 104 are mounted in the cup shaped portions of the pistons so that an annular air gap 106 is provided. A snap ring 108 is preferably located centrally of each cylinder for maintaining centered the opposed pistons when they are actuated inwardly by the opposed magnets. The end faces of the opposed magnets of each pair of opposed pistons preferably extend inwardly of the inner rim edges of the pistons so that when the magnets pull the pistons together the rim edges of the pistons are in contact with the snap ring in each cylinder which thereby lock centers the pistons in the cylinder and presents them from drifting. The pull-in distance is as shown at numeral 110. The extended annular rim of the pistons should be provided with relief openings 111 so that hydraulic fluid may enter into annular gap 106 of the pistons to separate them when pressure fluid is applied. The lower pair of opposed pistons 92 and 94, as shown, are actuated into full inward stroke position. It will be observed that all pairs of pistons are adapted to be actuated continuously out of contact with the cam races 88 and 90 when the cylinders are pressure relieved and the cams are rotated, as in a tractor towing operation, thereby allowing the magnets to engage across the pull-in distance 110.

It will be apparent to those skilled in the art that various changes in the structure and relative arrangement of parts may be made without departing from the scope of my invention.

I claim:

1. In a fixed displacement fluid pump or motor having a plurality of piston means reciprocable in cylinder means and means normally in driving or driven contact with said piston means, magnet means cooperating with said piston means and operable only under certain conditions of relatively low fluid operating pressure in said cylinder means to hold said piston means out of contact with said driving or driven means, and valve means in fluid communication with said cylinder means through passage means in at least a portion of said magnet means.

2. A fluid pump or motor as claimed in claim 1 wherein said driving or driven means is camming means and said piston means includes ball or roller means adapted normally to be thrust in continuous contact with said camming means under fluid pressure in said cylinder means, said magnet means under said certain relatively low cylinder pressure conditions actuating said piston means to a position beyond one end of the normal piston stroke.

3. A fluid pump or motor as claimed in claim 1 wherein said piston contact means comprises camming means and said piston means are normally reciprocated in said cylinder means by maintaining contact with said camming means during relative rotation between the piston and camming means, said magnet means being adapted to hold said piston means continuously out of contact with said caming means under said certain low cylinder pressure conditions.

4. A fluid pump or motor as claimed in claim 1 wherein said magnet means comprises in each said piston and cylinder means a permanent magnet and a pole piece.

5. A fluid pump or motor as claimed in claim 1 wherein the reciprocating piston means is in continuous substantially fluid sealed relation to the walls of the cylinder means.

6. A fluid pump or motor as claimed in claim 1 wherein each said piston means incudes a piston element substantially fluid sealed in said cylinder means and a ball or roller means secured to the outer end of the piston element, said passage means extending also through the piston element to provide fluid lubrication to the ball or roller means.

7. A fluid pump or motor as claimed in claim 1 wherein said magnet means includes a magnet in a magnetic circuit in each said piston and cylinder means which generates a magnetic linear pulling force on the piston capable of actuating it beyond the normal extreme one end of the reciprocatory driving or driven stroke thereof.

8. A fluid pump or motor as claimed in claim 7 wherein the magnet and circuit include a permanent magnet secured to each piston in spaced relation to the side walls of the cylinder and a pole piece in minimal normal axial spaced relation to each permanent magnet at one end of the piston stroke, said axial space being the distance traversed by the magnet while holding the piston out of contact with said driving or driven means.

9. A fluid pump or motor as claimed in claim 7 wherein said magnet and circuit comprise a permanent magnet secured in one end of each cylinder means in axial spaced relation from the opposed end of the respective piston and adapted under said certain conditions to actuate the piston into abutment with the magnet.

10. A fluid pump or motor as claimed in claim 7 wherein said piston means includes pairs of opposed pistons, and said magnet and circuit comprise a permanent magnet of opposite polarity secured in opposed relationship in each such pair of pistons for holding each such pair of pistons in close adjacent relationship continuously out of contact with said camming means.

11. A fluid pump or motor as claimed in claim 1 wherein said cylinder means are normally charged with pressure fluid sufficient to prevent the magnet means during operation from actuating said piston means out of contact with said driving or driven means, said piston means being actuated during rotation relative to said driving or driven means into extreme actuated positions closely spaced from the one end of the cylinder means such that release of fluid pressure in the cylinder means during such relative rotation causes each piston to be actuated out of contact with said driving or driven means and held in a position beyond said extreme actuated position thereof by the magnet means.

* * * * *